US011749144B2

(12) United States Patent
Wang et al.

(10) Patent No.: US 11,749,144 B2
(45) Date of Patent: Sep. 5, 2023

(54) PANEL DRIVING DEVICE AND METHOD, AND DISPLAY DEVICE

(71) Applicant: BOE TECHNOLOGY GROUP CO., LTD., Beijing (CN)

(72) Inventors: Yongbo Wang, Beijing (CN); Kelong Luan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 591 days.

(21) Appl. No.: 16/956,975

(22) PCT Filed: Jul. 22, 2019

(86) PCT No.: PCT/CN2019/097139
§ 371 (c)(1),
(2) Date: Jun. 22, 2020

(87) PCT Pub. No.: WO2021/012160
PCT Pub. Date: Jan. 28, 2021

(65) Prior Publication Data

US 2022/0406233 A1 Dec. 22, 2022

(51) Int. Cl.
*G09G 3/36* (2006.01)
*G09G 3/00* (2006.01)

(52) U.S. Cl.
CPC ..... *G09G 3/006* (2013.01); *G09G 3/36* (2013.01); *G09G 2330/02* (2013.01); *G09G 2330/12* (2013.01); *G09G 2370/16* (2013.01)

(58) Field of Classification Search
CPC ..... G09G 3/006; G09G 3/36; G09G 2330/02; G09G 2330/12; G09G 2370/16;
(Continued)

(56) References Cited

U.S. PATENT DOCUMENTS 9,412,290 B2 8/2016 Jack et al.
9,842,078 B2 * 12/2017 Tsai ..... G09G 3/2096
(Continued)

FOREIGN PATENT DOCUMENTS

CA 2916862 A1 12/2014
CN 101533602 A 9/2009
(Continued)

OTHER PUBLICATIONS

First Office Action for CN Patent Application No. 201980001107.9 dated Feb. 21, 2022.
(Continued)

*Primary Examiner* — Pegeman Karimi
(74) *Attorney, Agent, or Firm* — Perilla Knox & Hildebrandt LLP; Kenneth A. Knox

(57) ABSTRACT

The present disclosure provides a panel driving device and a panel device. The panel driving device includes a transmitting device, a receiving device, a conversion device, and a driver circuit. The transmitting device includes a first transmitting circuit for transmitting a first signal. The receiving device is provided on the panel and including a first receiving circuit for receiving the first signal transmitted by the transmitting device. The conversion device is connected to one of the first transmitting circuit and the first receiving circuit, and is configured to convert a second signal received by the conversion device and output a third signal. The driver circuit is provided on the panel and is configured to output a driving signal according to the third signal and provide the driving signal to the panel.

17 Claims, 6 Drawing Sheets

(58) Field of Classification Search
CPC ..... G09G 3/3696; G09G 3/3208; G09G 2380/06; G09G 2380/10; G09G 2380/12
See application file for complete search history.

(56) References Cited

U.S. PATENT DOCUMENTS

| | | | | |
|---|---|---|---|---|
| 9,897,830 | B2 | 2/2018 | Fu | |
| 10,120,258 | B2 | 11/2018 | Jack et al. | |
| 10,223,955 | B2 | 3/2019 | Wang | |
| 10,451,950 | B2 | 10/2019 | Jack et al. | |
| 2012/0133599 | A1* | 5/2012 | Cho | G06F 3/04164 345/173 |
| 2015/0002919 | A1 | 1/2015 | Jack et al. | |
| 2015/0187317 | A1 | 7/2015 | Seo | |
| 2016/0377949 | A1 | 12/2016 | Jack et al. | |
| 2017/0219856 | A1 | 8/2017 | Fu | |
| 2018/0012558 | A1* | 1/2018 | Seo | H04B 5/0081 |
| 2018/0061304 | A1 | 3/2018 | Wang | |
| 2018/0341163 | A1 | 11/2018 | Jack et al. | |
| 2019/0324342 | A1 | 10/2019 | Jack et al. | |

FOREIGN PATENT DOCUMENTS

| | | | |
|---|---|---|---|
| CN | 201349354 | Y | 11/2009 |
| CN | 104882111 | A | 9/2015 |
| CN | 104965321 | A | 10/2015 |
| CN | 105869591 | A | 8/2016 |
| CN | 108766328 | A | 11/2018 |
| CN | 108877609 | A | 11/2018 |
| EP | 3014349 | A1 | 5/2016 |
| EP | 3014349 | B1 | 8/2018 |
| EP | 3415984 | A1 | 12/2018 |
| WO | 2014209812 | A1 | 12/2014 |

OTHER PUBLICATIONS

Written Opinion for International Patent Application No. PCT/CN2019/097139 dated Apr. 15, 2020.

* cited by examiner

PANEL DRIVING DEVICE AND METHOD, AND DISPLAY DEVICE

CROSS-REFERENCE TO RELATED APPLICATION

This application is based on and claims priority to International Application No. PCT/CN2019/097139, filed Jul. 22, 2019, the contents of which being incorporated by reference in their entirety herein.

TECHNICAL FIELD

The present disclosure relates to display technologies, and in particular, to a panel driving device and method, and a display device.

BACKGROUND

With the development and progress of various technologies, the application of liquid crystal glass is becoming more and more extensive, for example, in liquid crystal display devices or color-changing glass. The liquid crystal display device or the color-changing glass usually includes a power supply circuit and liquid crystal glass. Generally, the power supply circuit and the liquid crystal glass are connected through cables. In some application scenarios, the power supply circuit can move relative to the liquid crystal glass, for example, automobile glass. The relative movement of the power supply circuit and the liquid crystal glass causes the cables to be damaged, which in turn makes the product have low reliability and short service life.

It should be noted that the information disclosed in the Background section above is only for enhancing the understanding of the background of the present disclosure, and thus may include information that does not constitute prior art known to those of ordinary skill in the art.

SUMMARY

An objective of the present disclosure is to provide a panel driving device and a panel device, so as to address the problem of low reliability and short service life of the product caused by the risk that the cables may be damaged due to the relative movement of the power supply circuit and the liquid crystal glass.

According to a first aspect of the present disclosure, there is provided a panel driving device for a panel device, the panel device including a panel, and the panel driving device including:

a transmitting device including a first transmitting circuit for transmitting a first signal;

a receiving device provided on the panel and including a first receiving circuit for receiving the first signal transmitted by the transmitting device;

a conversion device connected to one of the first transmitting circuit and the first receiving circuit and configured to convert a second signal received by the conversion device and output a third signal; and a driver circuit provided on the panel and configured to output a driving signal according to the third signal and provide the driving signal to the panel.

According to an embodiment, the conversion device is connected to the first transmitting circuit, the second signal is a power signal, and the conversion device is configured to output the third signal to the first transmitting circuit;

wherein the first transmitting circuit is configured to transmit the first signal according to the third signal; and wherein the first receiving circuit is connected to the driver circuit, the first receiving circuit is further configured to output a fourth signal according to the first signal, and the driver circuit is configured to output the driving signal according to the fourth signal.

According to an embodiment, the conversion device includes:

a first voltage conversion circuit configured to convert the second signal into a first target signal;

a first waveform conversion circuit connected to the first voltage conversion circuit and configured to convert a waveform of the first target signal to output the third signal; and a first control circuit connected to the first voltage conversion circuit and the first waveform conversion circuit, and configured to control the first voltage conversion circuit and the first waveform conversion circuit.

According to an embodiment, the receiving device further includes:

a feedback detection circuit connected to the first receiving circuit, and configured to detect the fourth signal output by the first receiving circuit and generate a fifth signal according to the fourth signal; and a second transmitting circuit connected to the feedback detection circuit and configured to receive the fifth signal and transmit a feedback signal according to the fifth signal.

According to an embodiment, the feedback detection circuit includes:

a first rectifier circuit connected to the first receiving circuit and configured to convert the fourth signal into a first direct current driving signal and output the first direct current driving signal;

a first energy storage circuit connected to the first rectifier circuit and configured to store the first direct current driving signal;

a first voltage stabilizing circuit connected to the first energy storage circuit, and configured to perform voltage stabilization on the first direct current driving signal and output a first voltage-stabilized signal;

a second control circuit connected to the first voltage stabilizing circuit, the first receiving circuit and the second transmitting circuit, and configured to receive the first voltage-stabilized signal output from the first voltage stabilizing circuit and the fourth signal output from the first receiving circuit, and output the fifth signal to the second transmitting circuit according to the fourth signal.

According to an embodiment, the second control circuit includes:

a voltage detection sub-circuit connected to the first voltage stabilizing circuit and the first receiving circuit, and configured to detect a voltage of the fourth signal;

a power determination sub-circuit connected to the voltage detection sub-circuit and configured to determine a power of the fourth signal; and an error determination sub-circuit connected to the voltage detection sub-circuit, the power determination sub-circuit and the second transmitting circuit, and configured to determine a voltage error and a power error of the fourth signal and send the voltage error and a power error of the fourth signal to the transmitting device.

According to an embodiment, the transmitting device further includes:

a second receiving circuit connected to the conversion device and configured to receive the feedback signal and output a feedback control signal to the conversion device according to the feedback signal.

According to an embodiment, the fourth signal includes a driving control signal, and the receiving device further includes:

a communication controller connected to the first voltage stabilizing circuit and the second control circuit, wherein the second voltage stabilizing circuit is configured to supply power electricity to the communication controller, and the communication controller is configured to obtain the first feedback signal from the second control circuit and send the first feedback signal.

According to an embodiment, the second control circuit includes:

a detection sub-circuit connected to the first receiving circuit and the communication controller, and configured to detect and separate the driving control signal, and transmit the driving control signal to the communication controller, wherein the communication controller is further connected to the driver circuit to transmit the driving control signal to the driver circuit.

According to an embodiment, the conversion device is provided on the panel, and the conversion device is connected to the first receiving circuit and the driver circuit, and the first receiving circuit is configured to output the second signal according to the first signal and transmit the second signal to the conversion device.

According to an embodiment, the receiving device further includes:

a control signal receiving circuit configured to receive a first control signal and output a second control signal, wherein the control signal receiving circuit is connected to the conversion device, and the conversion device converts the second signal into the third signal in response to the second control signal.

According to an embodiment, the conversion device includes:

a second rectifier circuit connected to the first receiving circuit and configured to convert the second signal into a second direct current power signal;

a second energy storage circuit connected to the second rectifier circuit and configured to store the second direct current power signal;

a second voltage stabilizing circuit connected to the second energy storage circuit, and configured to perform voltage stabilization on the second direct current power signal and output a second voltage-stabilized signal;

a second voltage conversion circuit connected to the second voltage stabilizing circuit to convert the second voltage-stabilized signal into a second target signal;

a second waveform conversion circuit connected to the second voltage conversion circuit and configured to convert a waveform of the second target signal to output the third signal;

a third control circuit connected to the second voltage stabilizing circuit, the second voltage conversion circuit and the second waveform conversion circuit, and configured to control the second voltage conversion circuit and the second waveform conversion circuit; wherein the second voltage stabilizing circuit is further configured to provide working power supply to the third control circuit.

According to an embodiment, the transmitting device further includes:

a first recognition circuit connected to the first transmitting circuit and the second receiving circuit;

wherein the receiving device further includes:

a second recognition circuit connected to the first receiving circuit and the second transmitting circuit.

According to an embodiment, the first transmitting circuit includes:

a first transmitting coil connected to the conversion device and configured to transmit the first signal;

wherein the first receiving circuit includes:

a first receiving coil configured to receive the first signal.

According to another aspect of the present disclosure, there is provided a panel device including the panel driving device described above.

According to an embodiment, the panel device further includes a panel and a control board, wherein when the conversion device and the transmitting device are connected, the transmitting device and the conversion device are provided on the control board, the receiving device and the driver circuit are provided on the panel.

According to an embodiment, the panel device further includes a panel and a control board, wherein when the conversion device and the receiving device are connected, the receiving device, the conversion device and the driver circuit are provided on the panel, and the transmitting circuit is provided on the control board.

It should be understood that the above general description and the following detailed description are only exemplary and explanatory, and are not intended to limit the present disclosure.

BRIEF DESCRIPTION OF THE DRAWINGS

The above and other features and advantages of the present disclosure will become more apparent by describing example embodiments in detail with reference to the accompanying drawings.

DETAILED DESCRIPTION

Figure 1:
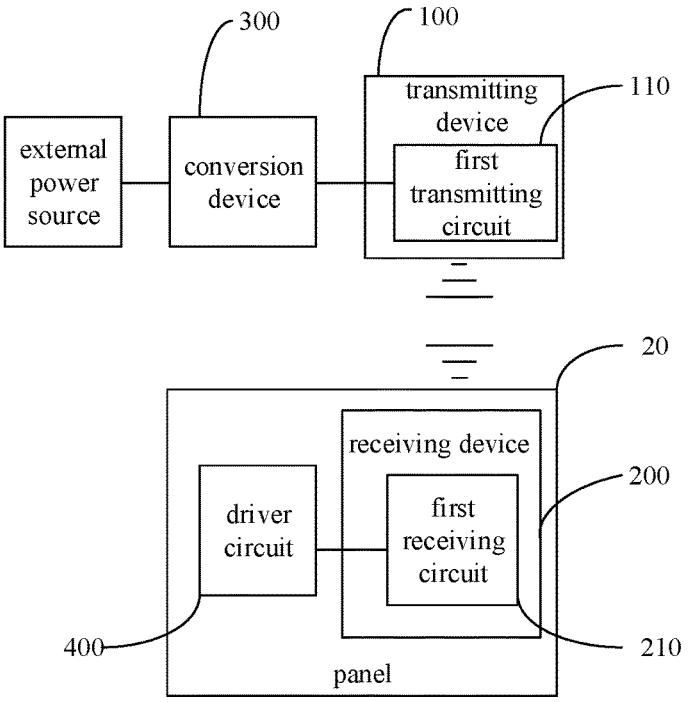
FIG. 1 is a schematic diagram of a panel driving device according to an exemplary embodiment of the present disclosure.

Example embodiments will now be described more fully with reference to the accompanying drawings. However, the embodiments can be implemented in a variety of forms and should not be construed as being limited to the examples set forth herein; rather, these embodiments are provided so that The present disclosure will be more complete so as to convey the idea of the exemplary embodiments to those skilled in this art. The same reference numerals in the drawings denote the same or similar parts, and thus their repeated description will be omitted.

The described features, structures, or characteristics in one or more embodiments may be combined in any suitable manner. In the following description, many specific details are provided to give a full understanding of the embodiments of the present disclosure. However, those skilled in the art will realize that the technical solutions of the present disclosure may be practiced without one or more of the specific details, or other methods, components, materials, devices, steps, etc. may be used. In other instances, well-known structures, methods, devices, implementations, materials or operations are not shown or described in detail to avoid obscuring aspects of the present disclosure.

The block diagrams shown in the drawings are merely functional entities and do not necessarily have to correspond to physically independent entities. That is, these functional entities can be implemented in the form of software, or a part or all of these functional entities may be implemented in one or more sub-circuits for performing the function of the software, or a part of these functional entities, or these functional entities can be implemented in different networks and/or processor devices and/or microcontrollers.

Exemplary embodiments of the present disclosure provide a panel driving device for a panel device. The panel device includes a panel. The panel driving device includes: a transmitting device, a receiving device, a conversion device, and a driver circuit. The transmitting device includes a first transmitting circuit. The transmitting circuit is configured to transmit a first signal. The receiving device is provided on the panel, and the receiving device includes a first receiving circuit. The first receiving circuit is configured to receive the first signal transmitted by the transmitting device. The conversion device is connected to one of the first transmitting circuit and the first receiving circuit, and is configured to convert a second signal received by the conversion device and output a third signal. The driver circuit is provided on the panel, and the driver circuit is configured to output the driving signal according to the third signal and provide the driving signal to the panel. The first transmitting circuit and the first receiving circuit are wirelessly connected, for example, the first transmitting circuit and the first receiving circuit are coupled through a mutual inductance coil.

In the panel driving device according to embodiments of the present disclosure, the first transmitting circuit of the transmitting device transmits the first signal, the first receiving circuit of the receiving device receives the first signal, the conversion device converts the received second signal and outputs the third signal, the drive circuit outputs a driving signal according to the third signal and wirelessly connects the driving panel, the transmitting device and the receiving device. On one hand, the panel driving device according to embodiments of the present disclosure solves the problem of low reliability and short service life of the product because the power supply circuit and the display module are connected through cables in the related art. Accordingly, the panel driving device according to embodiments of the present disclosure improves the reliability and service life of the product. On the other hand, because the need of connection cable is obviated, the installation and maintenance are simple.

Various parts of the panel driving device provided by the embodiments of the present disclosure will be described in detail below:

In an implementation of the present disclosure, as shown in FIG. 1, the panel device may include a panel 20, a conversion device 300 and a transmitting device 100. The conversion device 300 is connected to a first transmitting circuit 110 of the transmitting device 100. The second signal is a power signal. The conversion device 300 converts the power signal into a third signal and outputs the third signal to the first transmitting circuit 110. The third signal is converted into the first signal through the first transmitting circuit 110, and the first transmitting circuit 110 is configured to transmit the first signal according to the third signal.

The receiving device 200 and the driver circuit 400 are provided on the panel 20, the first receiving circuit 210 and the driver circuit 400 are connected, the first receiving circuit 210 receives the first signal, and the first receiving circuit 210 is further configured to output the fourth signal according to the first signal. The driver circuit 400 is configured to output a driving signal according to the fourth signal, and drive the panel 20 by the driving signal. For example, the driver circuit 400 may be implemented by an integrated circuit (IC) or the like to provide signals to the panel 20.

Figure 2:
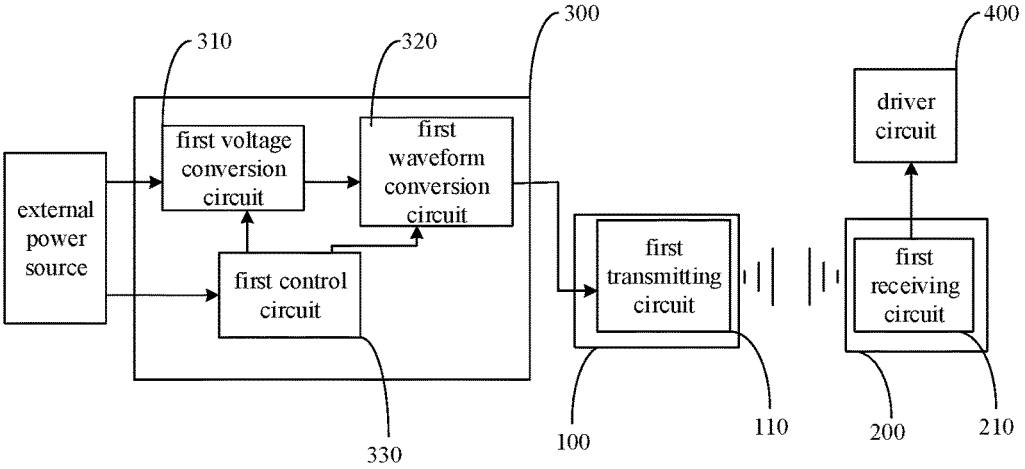
FIG. 2 is a schematic diagram of a panel driving device according to an exemplary embodiment of the present disclosure.

As shown in FIG. 2, the conversion device 300 may include a first voltage conversion circuit 310, a first waveform conversion circuit 320 and a first control circuit 330. The first voltage conversion circuit 310 is connected to an external power source, and is configured to convert the second signal into a first target signal. For example, the voltage of the externally input second signal is 27V, and the voltage requirement of the first target signal is 24V. The voltage conversion circuit 310 converts the second signal of 27V into the first target signal of 24V. The first waveform conversion circuit 320 is connected to the first voltage conversion circuit 310 to convert the waveform of the first target signal to output a third signal. The first control circuit 330 is connected to the first voltage conversion circuit 310 and the first waveform conversion circuit 320, and is configured to control the first voltage conversion circuit 310 and the first waveform conversion circuit 320. The first control circuit 330 outputs a voltage conversion control signal to the first voltage conversion circuit 310, and the first voltage conversion circuit 330 converts the second signal into the first target signal in response to the voltage conversion control signal and outputs the first target signal. The first control circuit 330 outputs a waveform conversion control signal to the first waveform conversion circuit 320, and the first waveform conversion circuit 320 converts the first target signal into a third signal in response to the waveform conversion control signal and outputs the third signal.

Figure 3:
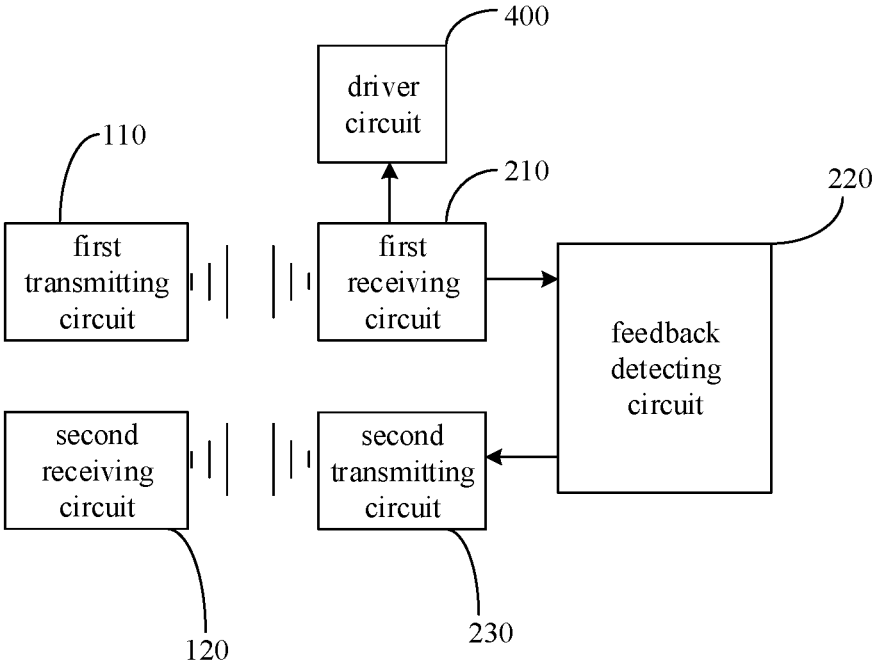
FIG. 3 is a schematic diagram of a panel driving device according to an exemplary embodiment of the present disclosure.
Figure 4:
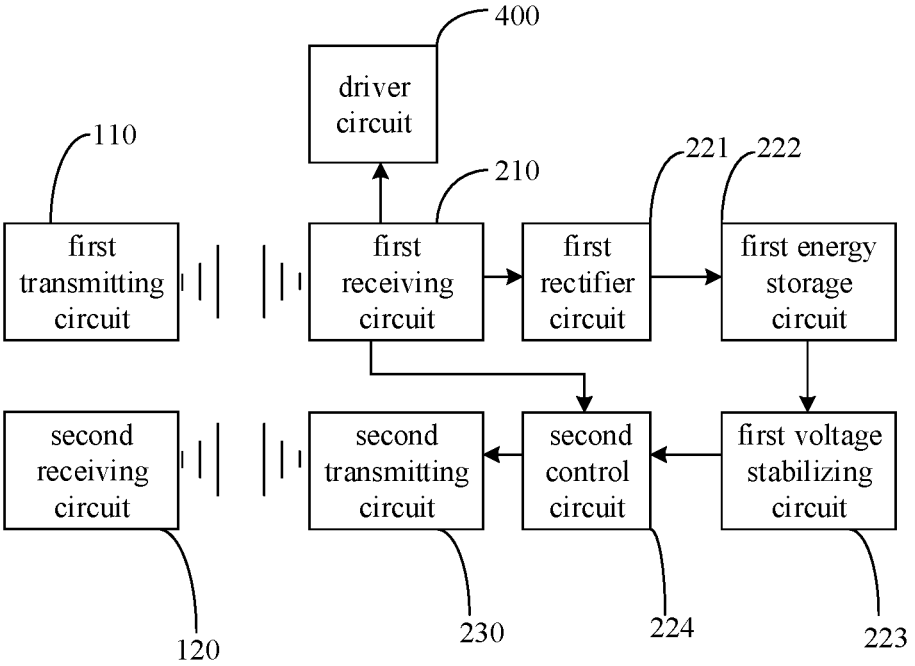
FIG. 4 is a schematic diagram of a panel driving device according to an exemplary embodiment of the present disclosure.
Figure 5:
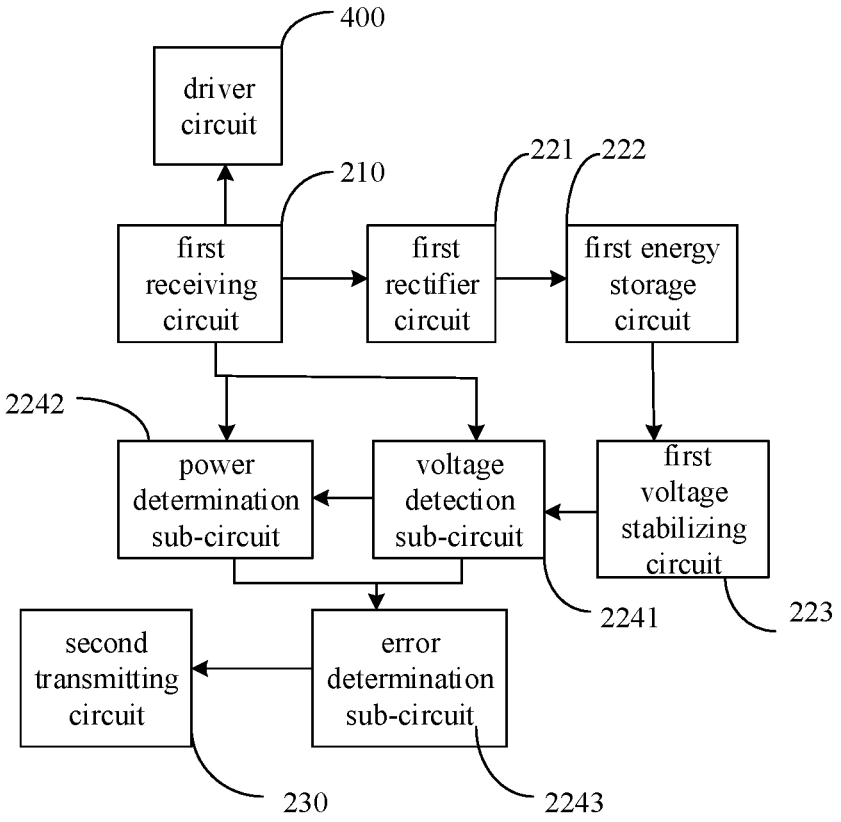
FIG. 5 is a schematic diagram of a panel driving device according to an exemplary embodiment of the present disclosure.

In an implementation of the present disclosure, as shown in FIG. 3, the receiving device 200 further includes a feedback detection circuit 220 and a second transmitting circuit 230. The feedback detection circuit 220 is connected to the first receiving circuit 210 and is configured to detect the fourth signal output by the first receiving circuit 210, and generate a fifth signal according to the fourth signal. The second transmitting circuit 230 is connected to the feedback detecting circuit 220, and is configured to receive the fifth signal and transmit the feedback signal according to the fifth signal.

The transmitting device 100 further includes a second receiving circuit 120. The second receiving circuit 120 is connected to the conversion device 300 and is configured to receive a feedback signal and output a feedback control signal to the conversion circuit according to the feedback signal. The conversion circuit receives the feedback control signal, and adjusts the parameters of the third signal (for example, the voltage and waveform of the third signal) output by the conversion circuit according to the feedback control signal.

The feedback detection circuit 220 may include a first rectifier circuit 221, a first energy storage circuit 222, a first voltage stabilizing circuit 223, and a second control circuit 224. The first rectifier circuit 221 is connected to the first receiving circuit 210 and is configured to convert the fourth signal into a first direct current driving signal and output the first direct current driving signal. The first energy storage circuit 222 is connected to the first rectifier circuit 221, and is configured to store the first direct current driving signal. The first voltage stabilizing circuit 223 is connected to the first energy storage circuit 222 and is configured to perform voltage stabilization on the first direct current driving signal and output a first voltage-stabilized signal. The second control circuit 224 is connected to the first voltage stabilizing circuit 223 and is configured to receive the first voltage-stabilized signal to provide working power source to the second control circuit 224. The second control circuit 224 is also connected to the first receiving circuit 210 and is configured to receive a fourth signal from the first receiving circuit. The second control circuit 224 is also connected to the second transmitting circuit and is further configured to output the fifth signal to the second transmitting circuit according to the fourth signal.

Further, the second control circuit 224 may include a voltage detection sub-circuit 2241, a power determination sub-circuit 2242, and an error determination sub-circuit 2243. The voltage detection sub-circuit 2241 is connected to the first voltage stabilizing circuit 223 and the first receiving circuit 210 and is configured to detect the voltage of the fourth signal output by the first receiving circuit. The power determination sub-circuit 2242 is connected to the voltage detection sub-circuit 2241 and is configured to determine the power of the fourth signal. The error determination sub-circuit 2243 is connected to the voltage detection sub-circuit 2241, the power determination sub-circuit 2242 and the second transmitting circuit 230, and is configured to determine the voltage error and the power error and output the fifth signal to the second transmitting circuit 230.

The voltage detection sub-circuit 2241 may include a voltage sensor. The voltage sensor detects the voltage of the fourth signal output by the first receiving circuit 210 in real time, and transmits the voltage to the power determination sub-circuit 2242 and the error determination sub-circuit 2243. The power determination sub-circuit 2242 may include a current detection device, such as a current sensor, to detect the current value of the fourth signal output by the first receiving circuit 210 through the current sensor. Then, according to the voltage value and current value of the fourth signal output by the first receiving circuit 210, the power determination sub-circuit 2242 may calculate the transmission power.

Figure 6:
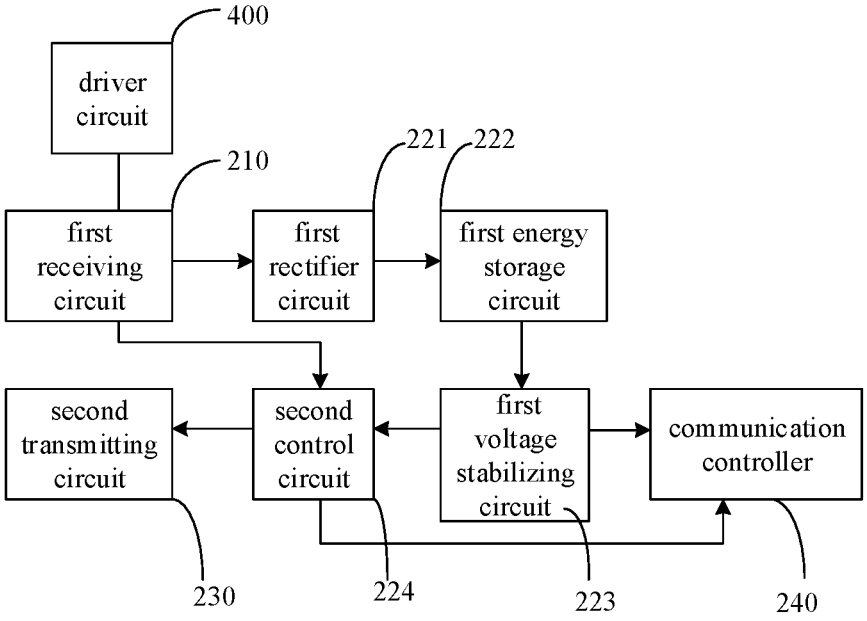
FIG. 6 is a schematic diagram of a panel driving device according to an exemplary embodiment of the present disclosure.

As shown in FIG. 6, the receiving device may further include a communication controller 240, which is connected to the first voltage stabilizing circuit 223 and the second control circuit 224. The second voltage stabilizing circuit 223 provides power source to the communication controller, and the communication controller 240 obtains the first feedback signal from the second control circuit 224 and sends the first feedback signal to an external device, such as a mobile phone or an on-board computer. The first feedback signal may include a voltage error and a power error. For example, the feedback signal may be the above fifth signal.

It can be understood that the fourth signal includes a driving control signal, that is, the signal transmitted through the first transmitting circuit 110 and the first receiving circuit 210 is a composite signal. For example, the composite signal may include a driving power signal and a driving control signal. The driving power signal may be a power signal of the driver circuit 400, and the driving control signal may be a control signal of the driver circuit 400, for example, a data signal, a scanning signal, or a compensation signal.

Figure 7:
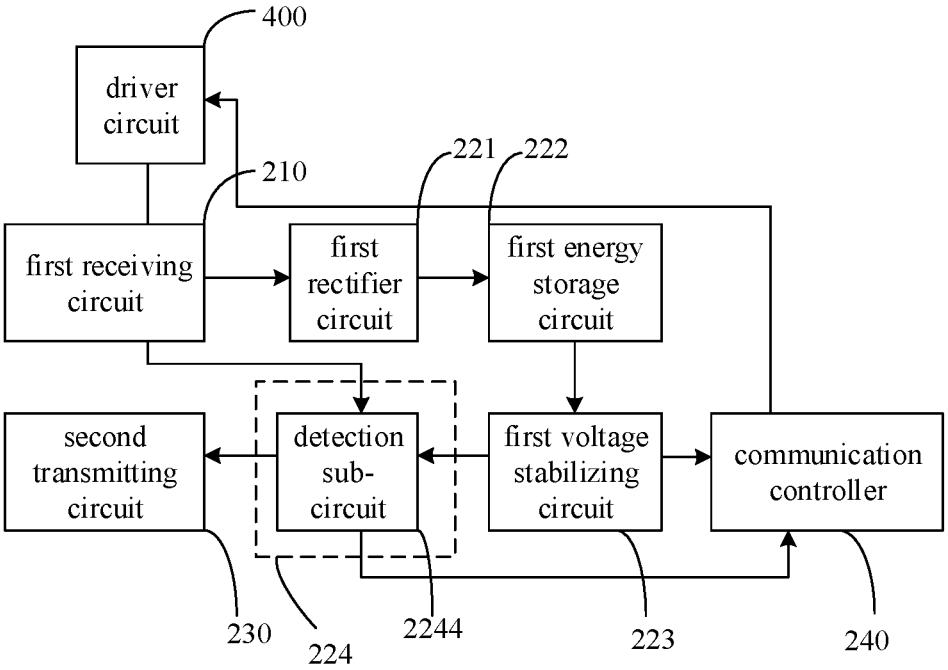
FIG. 7 is a schematic diagram of a panel driving device according to an exemplary embodiment of the present disclosure.

As shown in FIG. 7, the communication controller 240 is connected to the second control circuit 224, the first voltage stabilizing circuit 223 and the driver circuit 400. The first voltage stabilizing circuit 223 provides power source to the communication controller 240 and the second control circuit 224 separates the driving control signal from the fourth signal, the communication controller 240 transmits the driving signal to the driver circuit 400, and the driving control signal and the driving signal jointly drive the panel 20.

The second control circuit 224 includes a detection sub-circuit 2244. The detection sub-circuit 2244 is connected to the first receiving circuit 210 and the communication controller 240, and is configured to detect and separate the driving control signal and transmit the driving control signal to communication controller 240.

The communication controller 240 may include a communication sub-circuit and a check sub-circuit. The communication sub-circuit is connected to the detection and driver circuit 400 and is configured to transmit the driving control signal to the driver circuit 400. The check sub-circuit is connected to the detection sub-circuit 2244 and the second transmitting circuit 230 and is configured to check or verify the driving control signal and send the check result to the second transmitting circuit 230.

Figure 8:
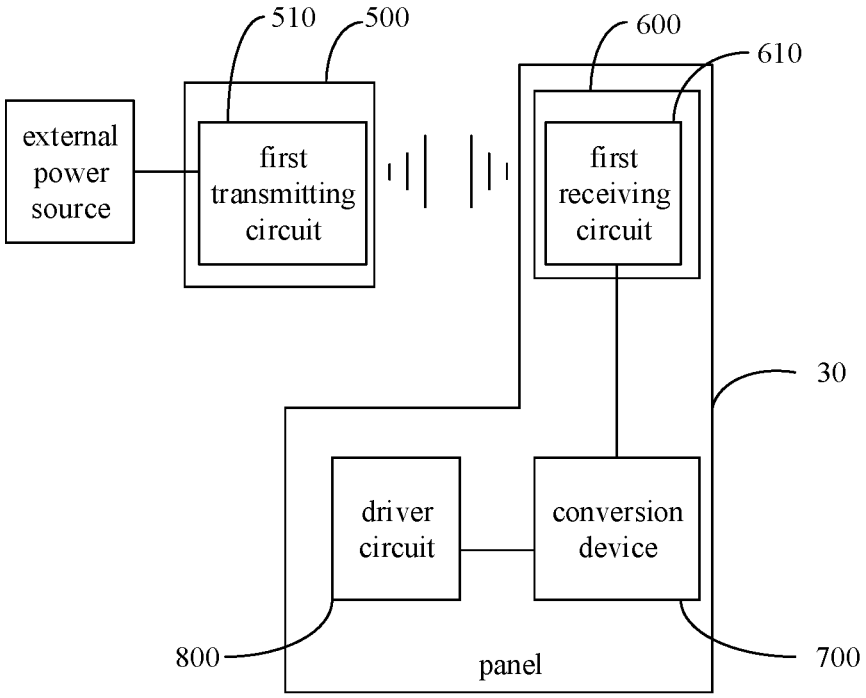
FIG. 8 is a schematic diagram of a panel driving device according to an exemplary embodiment of the present disclosure.

In an embodiment of the present disclosure, as shown in FIG. 8, the conversion device 700 is provided on the panel 30, and the conversion device 700 is connected to the first receiving circuit 610 and the driver circuit 800 of the receiving device 600. The first receiving circuit 510 outputs the second signal according to the first signal and transmits the second signal to the conversion device 700

The first transmitting circuit 510 of the transmitting device 500 is connected to the power signal, and sends the first signal to the first receiving circuit 610 according to the power signal. The first receiving circuit 610 receives the first signal and outputs the second signal to the conversion device 700 according to the first signal. The conversion device 700 converts the second signal to a third signal and outputs the third signal to the driver circuit 800. In this case, the second signal carries the driving power signal required by the driver circuit 800.

Further, the transmitting device 500 may further include a power source control circuit, which is provided between the power signal and the first transmitting circuit 510, and is configured to configure the power signal. The configuration of the power signal may be determined according to the target image to be displayed, or according to user operation.

In order to drive the driver circuit 800 by the driving power signal carried in the second signal, the receiving device 600 further includes a control signal receiving circuit 620. The control signal receiving circuit 620 is configured to receive the first control signal and output a second control signal according to the first control signal. The control signal receiving circuit 620 is connected to the conversion device 700, and the conversion device 700 converts the second signal into the third signal in response to the second control signal.

The control signal receiving circuit 620 may include a wireless transceiver module, such as one or more of a Bluetooth transceiver device, a wireless fidelity (Wi-Fi) transceiver device, or an infrared transceiver device or the like. A user can connect to the control signal receiving circuit 620 through a mobile phone, a tablet computer, an on-board computer, or the like, and send the first control signal to the control signal receiving circuit 620.

Figure 9:
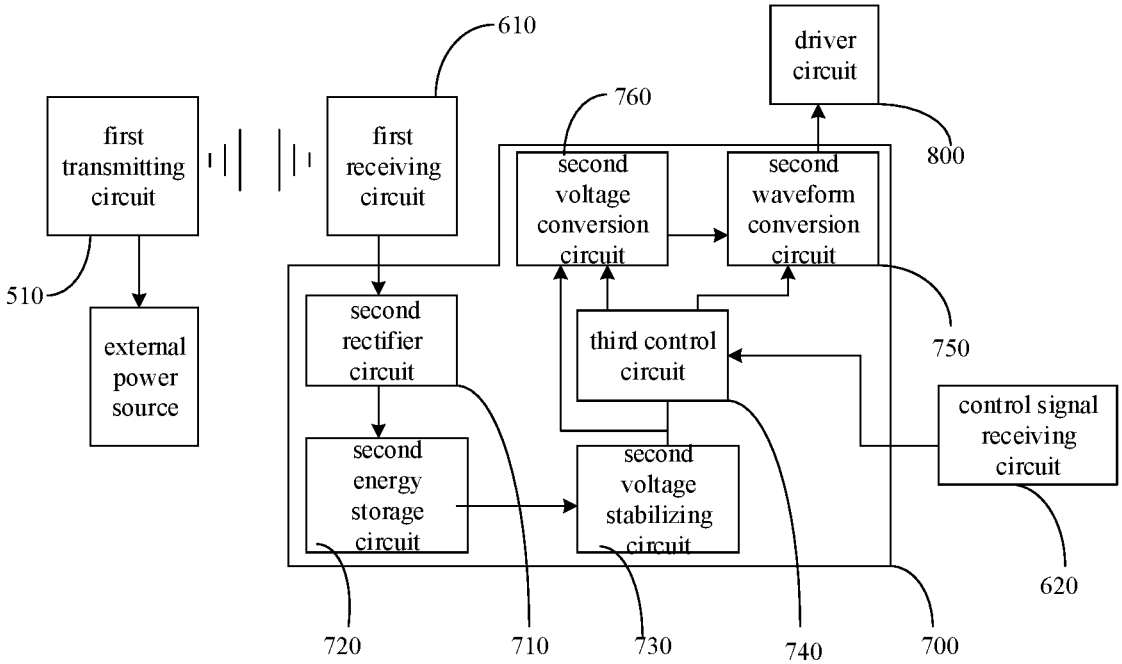
FIG. 9 is a schematic diagram of a panel driving device according to an exemplary embodiment of the present disclosure.

As shown in FIG. 9, the conversion device 700 may include a second rectifier circuit 710, a second energy storage circuit 720, a second voltage stabilizing circuit 730, a second voltage conversion circuit 760, a second waveform conversion circuit 750, and a third control circuit 740. The second rectifier circuit 710 is connected to the first receiving circuit 610 and is configured to convert the second signal into a second direct current power signal. The second energy storage circuit 720 is connected to the second rectifier circuit 710 and is configured to store the second direct current power signal. The second voltage stabilizing circuit 730 is connected to the second energy storage circuit 720 and is configured to perform voltage stabilization on the second direct current power signal and output a second voltage-stabilized signal. The second voltage conversion circuit 760 is connected to the second voltage stabilizing circuit 730 and is configured to convert the second voltage-stabilized signal into a second target signal. The second waveform conversion circuit 750 is connected to the second voltage conversion circuit 760 and is configured to convert the waveform of the second target signal to output the waveform of the converted power signal to output the third signal. The third control circuit 740 is connected to the second voltage conversion circuit 760 and the second waveform conversion circuit 750, and is configured to output a voltage conversion control signal to the second voltage conversion circuit 760, and the third control circuit 740 is configured to output a waveform conversion control signal to the second waveform conversion circuit 750. The second voltage-stabilized signal output by the second voltage stabilizing circuit 730 provides working power source to the third control circuit 740, and the third control circuit 740 generates the voltage conversion control signal and the waveform conversion control signal in response to the second control signal output by the control signal receiving circuit 620.

Figure 10:
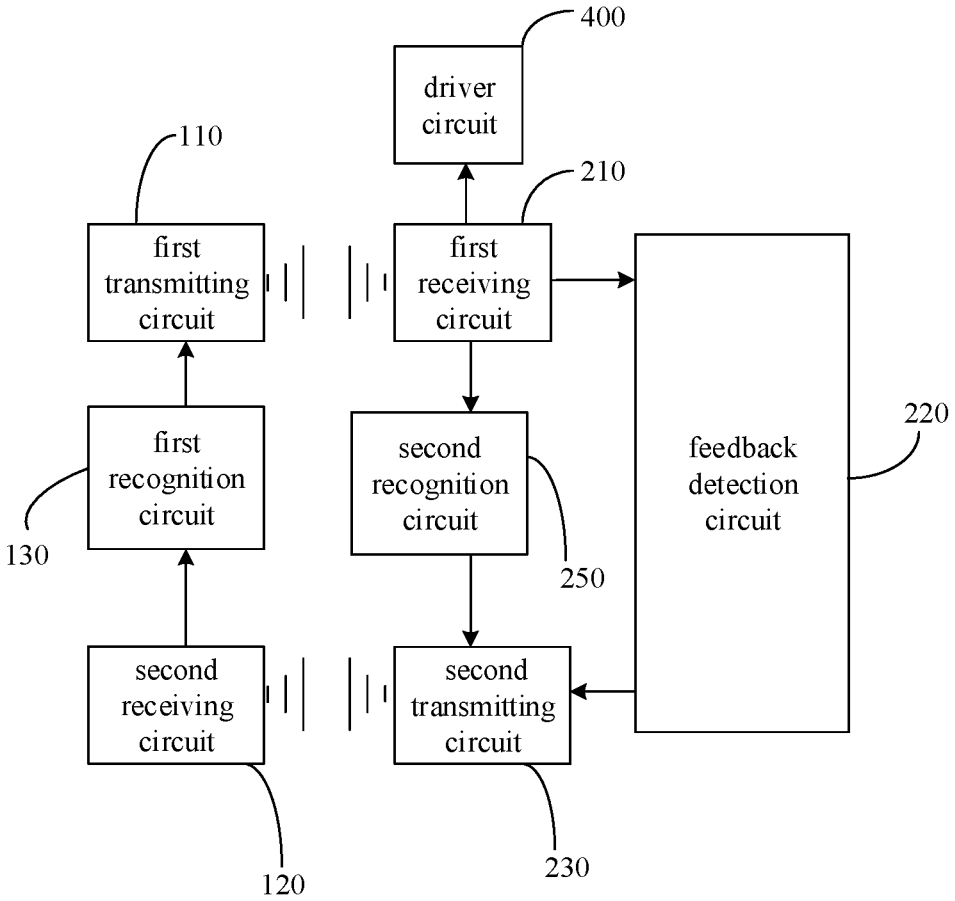
FIG. 10 is a schematic diagram of a panel driving device according to an exemplary embodiment of the present disclosure.

In order to realize the recognition and matching of the receiving device and the transmitting device, the panel driving device may be further optimized on the basis of the embodiment of FIG. 3. As shown in FIG. 10, the transmitting device further includes a first recognition circuit 130. The first recognition circuit 130 is connected to the first transmitting circuit 110 and the second receiving circuit 120 and is configured to control the first transmitting circuit to transmit a recognition signal and receive a signal output from the second receiving circuit. The receiving device further includes a second recognition circuit 250. The second recognition circuit 250 is connected to the first receiving circuit 210 and the second transmitting circuit 230. The first receiving circuit 210 is configured to receive the recognition signal transmitted by the first transmitting circuit 110. The second recognition circuit 250 is configured to determine whether the receiving device matches the transmitting device according to the signal output by the first receiving circuit 210. If the receiving device and the transmitting device match one another, the second recognition circuit 250 controls the second transmitting circuit 230 to transmit a matching signal, and the second receiving circuit 120 of the transmitting device receives the matching signal and feeds it back to the first recognition circuit 130. This indicates that the matching of the transmitting device and the receiving device is successful. Specifically, in the recognition process, based on the current change generated by resonance, the first recognition circuit transmits the current change via the first transmitting circuit to detect the presence of the receiving device. When it is detected that the receiving device is approaching, the first recognition circuit controls the first transmitting circuit to transmit an identification signal, the receiving device receives the identification signal through the first receiving circuit, and perform identification through the second recognition circuit. After the identification is performed, the second recognition circuit controls the second transmitting circuit to transmit the matching feedback signal to the second receiving circuit of the transmitting device, and the transmitting device confirms the identity of the receiving device according to the matching feedback signal. After confirming the identity of the receiving device, the transmitting device configures the power signal and transmits the poser signal to the receiving device. It should be noted that in the matching and identification stage of the transmitting device and the receiving device, the feedback detection circuit may not be used.

The first transmitting circuit includes a first transmitting coil, and the first transmitting coil is connected to the conversion device and is configured to transmit the first signal. The first receiving circuit includes a first receiving coil for receiving the first signal. The second transmitting circuit includes a second transmitting coil, and the second receiving circuit includes a second receiving coil. The above coils are all mutual inductance coils, the first transmitting coil and the first receiving coil are coupled, and the second transmitting coil and the second receiving coil are coupled.

In practical applications, the first control circuit, the second control circuit, and the third control circuit may include an MCU (Microcontroller Unit, micro control unit) and an MCU power supply circuit, the first energy storage circuit may be a super capacitor, and the second energy storage circuit may be a super capacitor.

It should be noted that although several sub-circuits of the panel driving device are mentioned in the above detailed description, this division is not mandatory. In fact, according to the embodiments of the present disclosure, the features and functions of two or more sub-circuits described above may be embodied in one sub-circuit. Conversely, the features and functions of a sub-circuit described above can be further divided into multiple sub-circuits.

In the panel driving device according to embodiments of the present disclosure, the first transmitting circuit of the transmitting device transmits the first signal, the first receiving circuit of the receiving device receives the first signal, the conversion device converts the received second signal and outputs the third signal, the drive circuit outputs a driving signal according to the third signal and wirelessly connects the driving panel, the transmitting device and the receiving device. On one hand, the panel driving device according to embodiments of the present disclosure solves the problem of low reliability and short service life of the product because the power supply circuit and the display module are connected through cables in the related art. Accordingly, the panel driving device according to embodiments of the present disclosure improves the reliability and service life of the product. On the other hand, because the need of connection cable is obviated, the installation and maintenance are simple.

In embodiments of the present disclosure, through the wireless connection between the transmitting device and the receiving device, the electricity energy from the transmitting device (e.g., a transmitting coil) can be delivered to the receiving device wirelessly, thereby converting the electricity signal into driving signals required by the panel. In addition, some control information may be delivered wirelessly between the transmitting device and the receiving device (e.g., via coils interaction).

Exemplary embodiments of the present disclosure also provide a signal driving method for the above panel driving device, the method including:

receiving a power signal, the power signal being sent by the transmitting device;

sending the power signal to the driver circuit to drive a display device to perform display through the driver circuit.

In the panel driving device according to embodiments of the present disclosure, the first transmitting circuit of the transmitting device transmits the first signal, the first receiving circuit of the receiving device receives the first signal, the conversion device converts the received second signal and outputs the third signal, the drive circuit outputs a driving signal according to the third signal and wirelessly connects the driving panel, the transmitting device and the receiving device. On one hand, the panel driving device according to embodiments of the present disclosure solves the problem of low reliability and short service life of the product because the power supply circuit and the display module are connected through cables in the related art. Accordingly, the panel driving device according to embodiments of the present disclosure improves the reliability and service life of the product. On the other hand, because the need of connection cable is obviated, the installation and maintenance are simple.

Further, when the transmitting device includes a first recognition circuit and the receiving device includes a second recognition circuit, the receiving power signal includes:

receiving an identification signal, the identification signal being transmitted through the first recognition circuit;

determining whether the identification signal matches the receiving device; and when the identification signal matches the receiving device, receiving the power signal.

The specific details of the steps of the display driving method in the above have been described in detail in the corresponding panel driving device, so they will not be repeated here.

Exemplary embodiments of the present disclosure also provide a panel device including the above panel driving device.

In an embodiment of the present disclosure, the panel device further includes a panel 20 and a control board. When the conversion device 300 and the transmitting device 100 are connected, the transmitting device 100 and the conversion device 300 are provided on the control board 10, the receiving device 200 and the driver circuit 400 are provided on the panel 20.

In an embodiment of the present disclosure, the panel device further includes a panel 30 and a control board. When the conversion device 700 and the receiving device 600 are connected, the receiving device 600, the conversion device 700 and the driver circuit 800 are provided on the panel 30, and the transmitting circuit is provided on the control board.

The panel includes liquid crystal glass, and the liquid crystal glass is connected to the driver circuit. The driver circuit is connected to the pixel electrode and the common electrode of the liquid crystal glass to form an electric field to drive the liquid crystal to deflect, thereby changing the light transmittance of the liquid crystal glass. For example, the liquid crystal glass can be applied to glass for automobiles, airplanes, or ships. Since glass for automobiles and the like need to be able to move relative to the body of the car, the glass needs to be able to adjust the light transmittance to adapt to different external environments. Thus, liquid crystal glass can be used. The transmitting device is installed on the body of the car, and the receiving device and the driver circuit are installed on the liquid crystal glass. The receiving device and the driver circuit can follow the movement of the liquid crystal glass, avoiding the problems that cables are easily damaged due to connecting the power supply and the driver circuit through the cables and the installation and maintenance are not convenient.

According to other embodiments, the panel may also be a liquid crystal display panel or an OLED display panel. When the display module is a liquid crystal display panel, the driver circuit is connected to the pixel electrode and the common electrode of the liquid crystal glass to form an electric field to drive the liquid crystal to deflect, thereby changing the light transmittance of the liquid crystal glass. When the display panel is an OLED display panel, the drive circuit is connected to the cathode and anode of the OLED light-emitting element, the driver circuit generates a drive current, and the drive current drives the OLED light-emitting element to emit light.

Those skilled in the art can understand that various aspects of the present invention can be implemented as a system, method, or program product. Therefore, various aspects of the present invention may be specifically implemented in the form of a complete hardware implementation, a complete software implementation (including firmware, microcode, etc.), or a combination of hardware and software, which may be collectively referred to herein as "circuit", "module", or "system".

In addition, the above-mentioned drawings are only schematic illustrations of processes included in the methods according to the exemplary embodiments of the present invention, and are not intended to limit the present disclosure. It is understood that the processes shown in the above drawings do not indicate or limit the chronological order of these processes. In addition, it is also understood that these processes may be performed synchronously or asynchronously in multiple modules, for example.

After considering the description and practicing the technical solutions disclosed herein, those skilled in the art will easily think of other embodiments of the present disclosure. This application is intended to cover any variations, uses, or adaptive changes of the present disclosure that follow the general principles of the present disclosure and include common general knowledge or customary technical means in the technical field not disclosed in the present disclosure. The description and examples are to be considered exemplary only, and the true scope and spirit of this disclosure are defined by the claims.

It should be understood that the present disclosure is not limited to the precise structure that has been described above and shown in the drawings, and that various modifications and changes can be made without departing from the scope of the present disclosure. The scope of the present disclosure is defined by the appended claims.

What is claimed is:

1. A panel driving device for a panel device, the panel device comprising a panel, and the panel driving device comprising:

a transmitting device comprising a first transmitting circuit for transmitting a first signal;

a receiving device provided on the panel and comprising a first receiving circuit for receiving the first signal transmitted by the transmitting device;

a conversion device connected to one of the first transmitting circuit and the first receiving circuit, and configured to convert a second signal received by the conversion device and output a third signal, wherein the conversion device is connected to the first transmitting circuit, the second signal is a power signal, and the conversion device is configured to output the third signal to the first transmitting circuit; and a driver circuit provided on the panel and configured to output a driving signal according to the third signal and provide the driving signal to the panel;

wherein the first transmitting circuit is configured to transmit the first signal according to the third signal; and wherein the first receiving circuit is connected to the driver circuit, the first receiving circuit is further configured to output a fourth signal according to the first signal, and the driver circuit is configured to output the driving signal according to the fourth signal.

2. The panel driving device according to claim 1, wherein the conversion device comprises:

a first voltage conversion circuit configured to convert the second signal into a first target signal;

a first waveform conversion circuit connected to the first voltage conversion circuit and configured to convert a waveform of the first target signal to output the third signal; and a first control circuit connected to the first voltage conversion circuit and the first waveform conversion circuit, and configured to control the first voltage conversion circuit and the first waveform conversion circuit.

3. The panel driving device according to claim 1, wherein the receiving device further comprises:

a feedback detection circuit connected to the first receiving circuit, and configured to detect the fourth signal output by the first receiving circuit and generate a fifth signal according to the fourth signal; and a second transmitting circuit connected to the feedback detection circuit and configured to receive the fifth signal and transmit a feedback signal according to the fifth signal.

4. The panel driving device according to claim 3, wherein the feedback detection circuit comprises:

a first rectifier circuit connected to the first receiving circuit and configured to convert the fourth signal into a first direct current driving signal and output the first direct current driving signal;

a first energy storage circuit connected to the first rectifier circuit and configured to store the first direct current driving signal;

a first voltage stabilizing circuit connected to the first energy storage circuit, and configured to perform voltage stabilization on the first direct current driving signal and output a first voltage-stabilized signal; and a second control circuit connected to the first voltage stabilizing circuit, the first receiving circuit and the second transmitting circuit, and configured to receive the first voltage-stabilized signal output from the first voltage stabilizing circuit and the fourth signal output from the first receiving circuit, and output the fifth signal to the second transmitting circuit according to the fourth signal.

5. The panel driving device according to claim 4, wherein the second control circuit comprises:

a voltage detection sub-circuit connected to the first voltage stabilizing circuit and the first receiving circuit, and configured to detect a voltage of the fourth signal;

a power determination sub-circuit connected to the voltage detection sub-circuit and configured to determine a power of the fourth signal; and an error determination sub-circuit connected to the voltage detection sub-circuit, the power determination sub-circuit and the second transmitting circuit, and configured to determine a voltage error and a power error of the fourth signal and send the voltage error and a power error of the fourth signal to the transmitting device.

6. The panel driving device according to claim 4, wherein the fourth signal comprises a driving control signal, and the receiving device further comprises:

a communication controller connected to the first voltage stabilizing circuit and the second control circuit, wherein the second voltage stabilizing circuit is configured to supply power electricity to the communication controller, and the communication controller is configured to obtain the a first feedback signal from the second control circuit and send the first feedback signal.

7. The panel driving device according to claim 6, wherein the second control circuit comprises:

a detection sub-circuit connected to the first receiving circuit and the communication controller, and configured to detect and separate the driving control signal, and transmit the driving control signal to the communication controller, wherein the communication controller is further connected to the driver circuit to transmit the driving control signal to the driver circuit.

8. The panel driving device according to claim 3, wherein the transmitting device further comprises: a second receiving circuit connected to the conversion device and configured to receive the feedback signal and output a feedback control signal to the conversion device according to the feedback signal.

9. The panel driving device according to claim 8, wherein the transmitting device further comprises:

a first recognition circuit connected to the first transmitting circuit and the second receiving circuit;

wherein the receiving device further comprises: a second recognition circuit connected to the first receiving circuit and the second transmitting circuit.

10. The panel driving device according to claim 1, wherein the first transmitting circuit comprises:

a first transmitting coil connected to the conversion device and configured to transmit the first signal;

wherein the first receiving circuit comprises: a first receiving coil configured to receive the first signal.

11. A panel driving device for a panel device having a panel, the panel driving device comprising:

a transmitting device comprising a first transmitting circuit for transmitting a first signal;

a receiving device provided on the panel and comprising a first receiving circuit for receiving the first signal transmitted by the transmitting device;

a conversion device connected to one of the first transmitting circuit and the first receiving circuit, and configured to convert a second signal received by the conversion device and output a third signal; and a driver circuit provided on the panel and configured to output a driving signal according to the third signal and provide the driving signal to the panel;

wherein the conversion device is provided on the panel, the conversion device is connected to the first receiving circuit and the driver circuit, and the first receiving circuit is configured to output the second signal according to the first signal and transmit the second signal to the conversion device; and wherein the receiving device further comprises: a control signal receiving circuit configured to receive a first control signal and output a second control signal, wherein the control signal receiving circuit is connected to the conversion device, and the conversion device converts the second signal into the third signal in response to the second control signal.

12. The panel driving device according to claim 11, wherein the conversion device comprises:

a second rectifier circuit connected to the first receiving circuit and configured to convert the second signal into a second direct current power signal;

a second energy storage circuit connected to the second rectifier circuit and configured to store the second direct current power signal;

a second voltage stabilizing circuit connected to the second energy storage circuit, and configured to perform voltage stabilization on the second direct current power signal and output a second voltage-stabilized signal;

a second voltage conversion circuit connected to the second voltage stabilizing circuit to convert the second voltage-stabilized signal into a second target signal;

a second waveform conversion circuit connected to the second voltage conversion circuit and configured to convert a waveform of the second target signal to output the third signal; and a third control circuit connected to the second voltage stabilizing circuit, the second voltage conversion circuit and the second waveform conversion circuit, and configured to control the second voltage conversion circuit and the second waveform conversion circuit, wherein the second voltage stabilizing circuit is further configured to provide a working power supply to the third control circuit.

13. A panel device comprising a panel driving device and a panel, the panel driving device comprising:

a transmitting device comprising a first transmitting circuit for transmitting a first signal;

a receiving device provided on the panel and comprising a first receiving circuit for receiving the first signal transmitted by the transmitting device;

a conversion device connected to one of the first transmitting circuit and the first receiving circuit and configured to convert a second signal received by the conversion device and output a third signal, wherein the conversion device is connected to the first transmitting circuit, the second signal is a power signal, and the conversion device is configured to output the third signal to the first transmitting circuit; and a driver circuit provided on the panel and configured to output a driving signal according to the third signal and provide the driving signal to the panel;

wherein the first transmitting circuit is configured to transmit the first signal according to the third signal; and wherein the first receiving circuit is connected to the driver circuit, the first receiving circuit is further configured to output a fourth signal according to the first signal, and the driver circuit is configured to output the driving signal according to the fourth signal.

14. The panel device according to claim 13, further comprising a control board, wherein, when the conversion device and the transmitting device are connected, the transmitting device and the conversion device are provided on the control board, and the receiving device and the driver circuit are provided on the panel.

15. The panel device according to claim 13, further comprising a control board, wherein, when the conversion device and the receiving device are connected, the receiving device, the conversion device, and the driver circuit are provided on the panel, and the transmitting circuit is provided on the control board.

16. The panel device according to claim 13, wherein the conversion device comprises:

a first voltage conversion circuit configured to convert the second signal into a first target signal;

a first waveform conversion circuit connected to the first voltage conversion circuit and configured to convert a waveform of the first target signal to output the third signal; and a first control circuit connected to the first voltage conversion circuit and the first waveform conversion circuit, and configured to control the first voltage conversion circuit and the first waveform conversion circuit.

17. The panel device according to claim 13, wherein the receiving device further comprises:

a feedback detection circuit connected to the first receiving circuit, and configured to detect the fourth signal output by the first receiving circuit and generate a fifth signal according to the fourth signal; and a second transmitting circuit connected to the feedback detection circuit and configured to receive the fifth signal and transmit a feedback signal according to the fifth signal.

* * * * *